United States Patent [19]

Maruyama et al.

[11] Patent Number: 4,486,158

[45] Date of Patent: Dec. 4, 1984

[54] ROTARY VANE COMPRESSOR WITH SUCTION PORT ADJUSTMENT

[75] Inventors: Teruo Maruyama, Neyagawa; Shinya Yamauchi, Katano; Nobuo Kagoroku, Otsu, all of Japan

[73] Assignee: Matsushita Electric Industrial Co., Ltd., Osaka, Japan

[21] Appl. No.: 343,862

[22] Filed: Jan. 29, 1982

[30] Foreign Application Priority Data

Jan. 29, 1981 [JP] Japan ..... 56-12426

[51] Int. Cl.[3] ..... F04C 18/00; F04C 29/08

[52] U.S. Cl. ..... 418/39; 418/150; 418/181; 418/259

[58] Field of Search ..... 418/39, 150, 181, 259, 418/270

[56] References Cited

U.S. PATENT DOCUMENTS 1,023,820 4/1912 Dennison ..... 418/181

2,491,100 12/1949 Frei ..... 418/179

FOREIGN PATENT DOCUMENTS 670793 4/1952 United Kingdom ..... 418/270

1344668 1/1974 United Kingdom ..... 417/273

*Primary Examiner*—John J. Vrablik

*Attorney, Agent, or Firm*—Stevens, Davis, Miller & Mosher

[57] ABSTRACT

A sliding vane type rotary compressor, of which refrigerating capacity at the high speed operation of the compressor is suppressed by making use of suction loss involved when refrigerant pressure in the vane chamber becomes lower than the pressure of the refrigerant supply source in the suction stroke of the compressor. The compressor has a rotor, vanes slidably carried by the rotor, a cylinder accommodating the rotor and the vane, side plates fixed to both sides of the cylinder for closing both open ends of the vane chambers defined by the rotor, vanes and the cylinder, and suction and discharge ports serving as passages for communicating the vane chambers with the outside of the compressor. A spacer for adjustment of the refrigerating capacity is disposed in the suction port. When the compressor of the invention is used in the refrigeration cycle of an automobile air conditioner, it is possible to obtain a desired refrigerating capacity controlling characteristics of the compressor matching the characteristics of the associated engine and automobile, simply by selecting a suitable spacer and mounting the same in the sucking section of the compressor, without substantially changing other parts of the compressor.

2 Claims, 27 Drawing Figures

ROTARY VANE COMPRESSOR WITH SUCTION PORT ADJUSTMENT

BACKGROUND OF THE INVENTION

The present invention relates to a rotary compressor and, more particularly, to the control of refrigerating capacity of an air conditioning system employing a rotary compressor.

Conventional rotary compressors of sliding vane type are finding spreading use as compressors of automobile air conditioners since they are compact and simple in construction as compared with conventional reciprocating type compressors which have a large number of parts and are of complicated construction. In comparison with the reciprocating type compressors, however, the known sliding vane type rotary compressors involve the following problems.

Namely, when used as a compressor of an automobile air conditioner, the rotary shaft of the compressor is driven by the driving power of the engine through a clutch having a pulley which is driven by the engine power via a belt. Therefore, with the sliding vane type compressor, its refrigerating capacity is increased substantially linearly in proportion to the speed of the engine.

On the other hand, with the reciprocating type compressor, the follow-up characteristics of its suction valve are degraded at high operation speeds so as not to provide full sucking of refrigerant gas into cylinders. In consequence, the refrigerating capacity levels off when the operation speed of the compressor is increased beyond a predetermined speed. In other words, the refrigerating capacity of a reciprocating type compressor is automatically suppressed during high speed running of the automobile, while such automatic suppressing function is not involved in the rotary compressor. Therefore, with the automobile air conditioner employing the rotary type compressor, an increased compression work results in the lowering of efficiency or in subcooling during high speed running of the automobile.

In order to avoid the above-described problem involved in the rotary compressor, it has been proposed to provide a control valve in a passage leading to a suction port formed in one of the side walls of the compressor, the control valve being adapted to be varied in the opening area of the passage depending upon the engine speed such that the opening area is reduced during high speed operation to cause suction loss which is utilized to control the refrigerating capacity. In this measure, however, a control valve must be additionally provided to thereby make the construction of the compressor complicated and raise the production cost.

As another measure for eliminating the drawback of the rotary compressor, i.e. excessive refrigerating capacity at high speed operation, it has been proposed also to adopt such a construction which includes a fluid clutch, planetary gear system and so forth to prevent the operation speed from being increased above a predetermined speed. In the construction having a fluid clutch, however, energy loss due to generation of heat at relatively moving surfaces is relatively large. On the other hand, in the construction having a planetary gear system, a large number of parts thereof make the size of the compressor large, which goes quite contrary to the current demand for simplification of the compressor and reduction of the size of the same to cope with the requirement of energy saving.

SUMMARY OF THE INVENTION

In order to overcome the above-described problems encountered when rotary type compressors are used practical use as the compressor of automobile refrigerator, the inventors of the present invention have already found out as a result of transient phenomena in the vane chamber pressure that a self-suppression of the refrigerating capacity at the high speed operation can be also attained in the rotary compressor as in reciprocating type compressors, provided that the parameters such as suction passage area, rate of discharge and number of vanes are suitably selected and combined, as proposed in Japanese Patent Application No. 134048/1980.

The present invention relates to an improvement in the invention proposed in the avove-mentioned patent application. According to the present invention, it is possible to readily provide a compressor having any desired refrigerating capacity control characteristics meeting the characteristics of the associated engine and automobile, which compressor includes a compression mechanism having a readily mountable spacer in the suction side passage.

DESCRIPTION OF THE PREFERRED EMBODIMENTS

Figure 1:
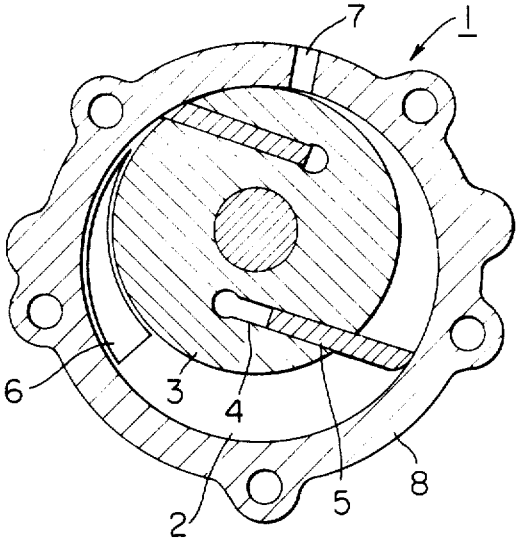
FIG. 1 is a front elevational sectional view of a conventional sliding vane type rotary compressor.

Referring to FIG. 1 showing a conventional sliding vane type rotary compressor, a cylinder 8 has a cylindrical space therein. Side plates (not shown in FIG. 1) are secured to both sides of the cylinder 8 so as to close both sides of vane chambers 2 defined in the cylinder 8. A rotor 3 is eccentrically disposed in the cylinder 8. The rotor 3 is provided with grooves 4 which slidably receive vanes 5. A suction port 6 is formed in the side plates and a discharge port 7 is formed in the cylinder 8. As the rotor 3 rotates, the vanes 3 project radially outwardly due to the centrifugal force to make a sliding contact with the inner peripheral surface of the cylinder 8 thereby to prevent leakage of the gas in the compressor.

Figure 2:
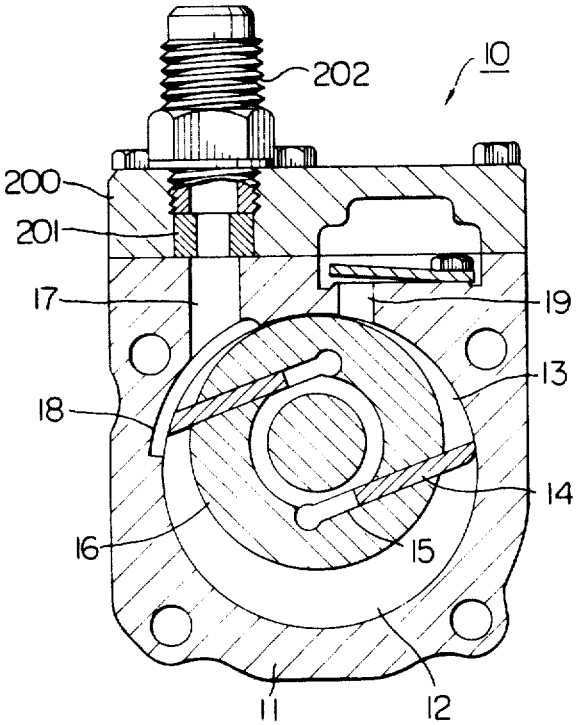
PRIOR ART FIG. 2
FIG. 2 is a front elevational sectional view of a rotary compressor in accordance with an embodiment of the invention.
Figure 3:
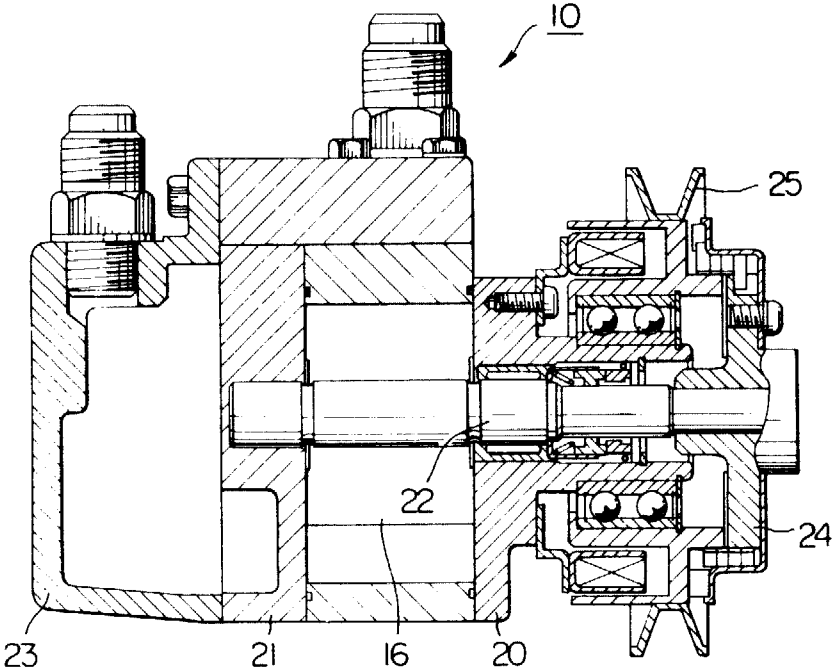
FIG. 3 is a side elevational sectional view of the rotary compressor shown in FIG. 2.

FIGS. 2 and 3 show a two-vane type rotary compressor 10 constructed in accordance with an embodiment of the invention. This compressor has a cylinder 11, low-pressure vane chamber 12, high-pressure vane chamber 13, vanes 14, vane grooves 15, rotor 16, suction port 17, suction groove 18 formed in the inner peripheral surface of the cylinder 11 and a discharge port 19. A reference numeral 200 denotes a head cover, 201 denotes a spacer and 202 denotes a joint for connecting with a suction pipe.

Referring first to FIG. 3, the compressor 10 further has a front panel 20 and a rear panel 21 serving as the side plates of the compressor, a rotor shaft 22, a rear case 23, a clutch disc 24 fixed to the rotor shaft 22, and a pulley 25.

Figure 4:
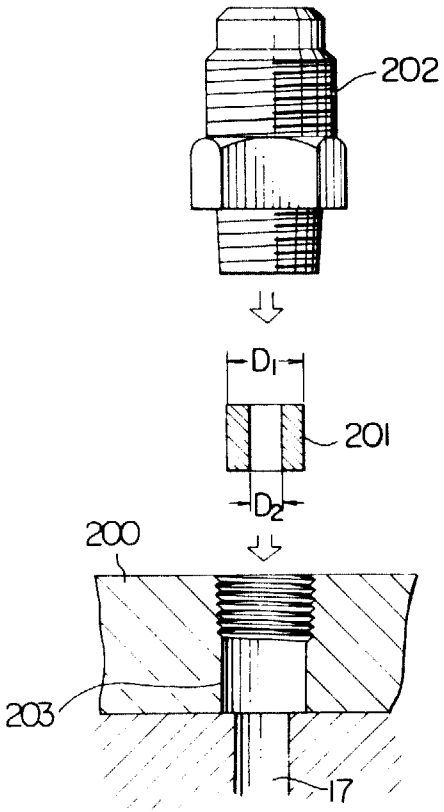
FIG. 4 illustrates the manner in which a spacer is mounted in the compressor of FIG. 2.

FIG. 4 shows the manner in which the spacer 201 is mounted in the spacer receiving compartment 203 formed in the cover 200. According to the invention, it is possible to easily provide a compressor, of which refrigerating control characteristics can match a variety of characteristics of the engines and automobiles, by a suitable selection of the spacer 201.

The compressor shown in FIG. 2 has the following specifications.

TABLE 1

| Parameters | Symbols | Values in embodiment |
|---|---|---|
| number of vanes | n | 2 |
| effective suction passage area | a | selectable by varying spacer as desired |
| theoretical discharge rate | Vth | 86 cc/rev. |
| Rotation angle at which vane end stops sucking | $\theta s$ | 270° |
| cylinder width | b | 40 mm |
| inner radius of cylinder | Rc | 33 mm$^R$ |
| rotor radius | Rr | 26 mm$^R$ |

Figure 6A:
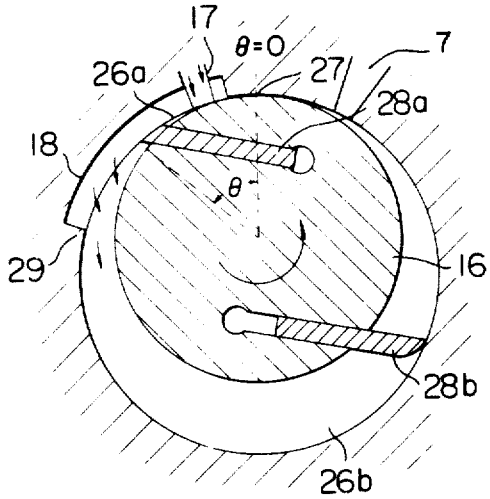
FIG. 6A shows a positional relationship between vanes and rotor in the state immediately after commencement of suction stroke.
Figure 6B:
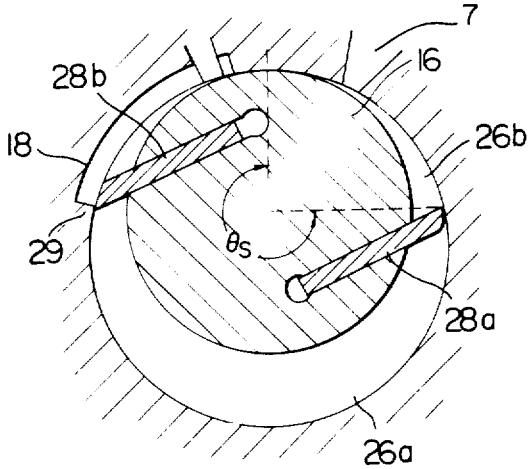
FIG. 6B shows a positional relationship between vanes and rotor in the state after the end of the suction stroke.

In Table 1 above, the angle $\theta s$ at which the sucking at the tip end of the vane stops is defined as follows. Referring to FIGS. 6A and 6B, reference numeral 26a denotes a vane chamber A, 26b denotes a vane chamber B, 27 denotes the top portion of the cylinder 11, 28a denotes a vane A, 28b denotes a vane B and 29 denotes the end of the suction groove.

With the center being positioned on the axis of rotation of the rotor 16, the angular position of each vane is represented by $\theta$. The position $\theta$ is determined as $\theta=0°$, when the tip end of the vane passes the top portion 27 of the cylinder. As to the vane chamber 26a, FIG. 6A shows the state in which the vane 28a has just passed the suction port 17, i.e. the state immediately after the suction stroke begins. A refrigerant is sucked into the vane chamber 26a directly through the suction port 17 and into the vane chamber 26b via the suction groove 18 as indicated by arrows.

FIG. 6B shows the state immediately after the suction stroke of the vane chamber 26a is over. In this state, the end tip of the vane 28b is positioned to face the end 29 of the suction groove. At this position, the volume of the vane chamber 26a defined by the vane 28a and vane 28b becomes maximum.

Figure 5A:
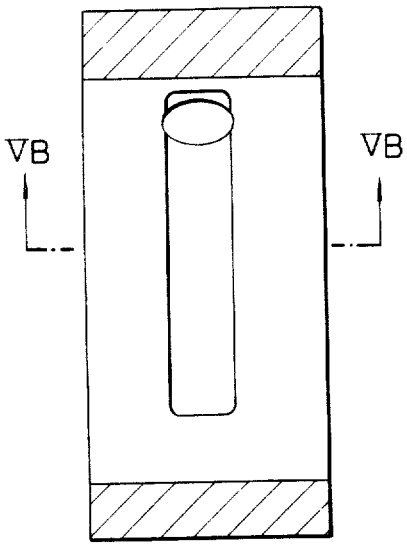
FIG. 5A shows the configuration of a suction port of the rotary compressor shown in FIG. 2.
Figure 5B:
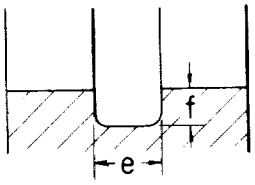
FIG. 5B is a sectional view taken along the line VB—VB of FIG. 5A.

FIGS. 5A and 5B show how the suction groove 18 is formed in the inner peripheral surface of the cylinder 11 in the embodiment shown in FIG. 2. More specifically, the suction groove and the suction port are formed such that, when the end tip of the vane 28a passes the suction groove 18 as shown in FIG. 6A, the cross-sectional area of the fluid passage leading from the suction pipe to the vane chamber 26b is minimum at the suction port 17, on the assumption that there is no spacer 201. Namely, representing the suction passage area by a' and the cross-sectional area of the suction groove by $S_1=e\times f$, the suction groove is formed in the inner peripheral wall of the cylinder to have a sufficiently large depth to meet the condition of $S_1>a'$.

With the arrangement stated above, when the spacer 201 is mounted, the effective area a of the suction fluid passage leading from the suction pipe to the vane chamber is determined substantially by the inside diameter $D_2$ of the spacer 201.

As used herein, the term "effective area" means the effective flow area, which value is obtained by multiplying the geometrical opening area by a coefficient of contraction.

In the embodiment shown in FIG. 2, the spacer 201 may be mounted in the final step of assembly before the mounting of the pipe joint 202 to the head cover 200, so that it is not at all necessary to modify the construction of other parts of the compressor nor to change the order of assembly of the same.

In the invention, the effective suction passage area is a factor having the following concept. When there is found the minimum of the cross-sectional area of the fluid passage leading from an evaporator to the vane chamber of the compressor, it is possible to grasp the approximate value of the effective suction passage area a by multiplying such minimum cross-sectional area by a coefficient of contraction which is usually 0.7 to 0.9. However, according to the invention, the effective suction passage area a is determined more strictly in the following experiment performed in accordance with a method specified by JIS B 8320 or the like as follows.

Figure 7:
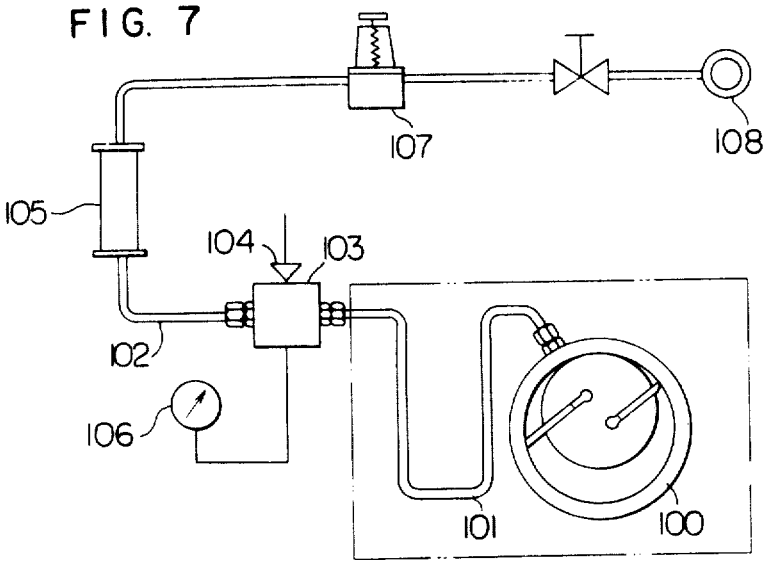
FIG. 7 illustrates an experimental instrument for measuring effective area of suction passage.

FIG. 7 shows an example of an instrument for use in the experiment for determining the effective suction passage area a. A reference numeral 100 denotes a compressor, 101 denotes a pipe for connecting an evaporator to the suction port of the compressor 100 when mounted on an automobile, 102 denotes a pipe for supplying a high pressure air, 103 denotes a housing to which the pipes 101 and 102 are connected, 104 denotes a thermo-couple, 105 denotes a flow meter, 106 denotes a pressure gauge, 107 denotes a pressure regulator valve and 108 denotes a high pressure air source.

In FIG. 7, the section surrounded by a two-dot-and-dash line corresponds to the compressor to which the invention pertains. If there is a restriction within the evaporator which presents an innegligible flow resistance, a restriction corresponding to such restriction should be provided in the pipe 101.

For measuring the effective suction passage area a in the compressor having the construction as shown in FIG. 3, an experiment is conducted with the clutch disc and pulleys 24, 25 demounted the front panel 20 demounted from the cylinder 11, in accordance with the following procedure.

Namely, the effective suction passage area a can be determined by the following formula (1):

$$a = G_1 / \sqrt{2g\gamma_1 P_1 \frac{\kappa_1}{\kappa_1 - 1}\left\{\left(\frac{P_2}{P_1}\right)^{\frac{2}{\kappa 1}} - \left(\frac{P_2}{P_1}\right)^{\frac{\kappa 1+1}{\kappa 1}}\right\}} \quad (1)$$

where $P_1$ represents the pressure of the high pressure air source (Kg/cm$^2$ abs), $P_2$ represents the atmospheric pressure which is assumed to be 1.03 Kg/cm$^2$ abs, $\kappa_1$ represents the specific heat ratio of air which is assumed to be 1.4, $\gamma_1$ represents the specific weight of air, g represents the acceleration of gravity which is 980 cm/sec$^2$ and $G_1$ represents the weight flow rate of air obtained under the above-stated condition.

It is, however, essential to select the pressure $P_1$ at a sufficiently high level to meet the condition shown below:

$$0.528 < P_2/P_1 < 0.9$$

Figure 8:
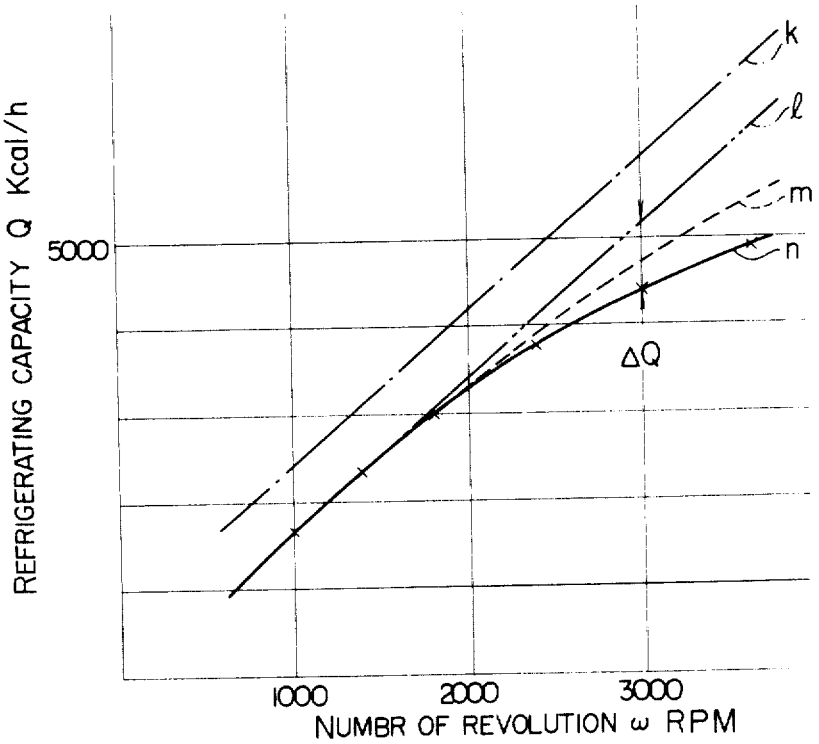
FIG. 8 is a graph showing the refrigerating capacity Q in relation to number of revolution in the rotary compressor of the invention shown in FIG. 2 in comparison with the ordinary rotary compressor.

FIG. 8 shows the result of measurment of the refrigerating capacity in relation to number of revolution in the compressor of the invention under the conditions shown in Table 1, which compressor includes a spacer 201 having the effective suction passage area a of 0.45 cm$^2$. The measurement was conducted by using a secondary refrigerant type calorimeter, under the condition shown in Table 2 below.

TABLE 2

| Parameters | Symbols | Values in embodiment |
|---|---|---|
| refrigerant pressure at supply side | Ps | 3.18 Kg/cm$^2$ abs |
| refrigerant temperature at supply side | $T_A$ | 238° K. |
| refrigerant pressure at discharge side | Pd | 15.51 Kg/cm$^2$ abs |
| number of revolution | $\omega$ | 600 to 5000 rpm |

The characteristic curve k shows the refrigerating capacity which is determined by the theoretical discharge rate of the compressor where there is no loss of the refrigerating capacity. The characteristic curve l shows an example of the refrigerating capacity characteristics of a conventional rotary compressor, while the characteristic curve m shows an example of the characteristics of conventional reciprocating type compressor. An example of the characteristics of the rotary compressor of the invention is shown by the curve n.

Figure 9:
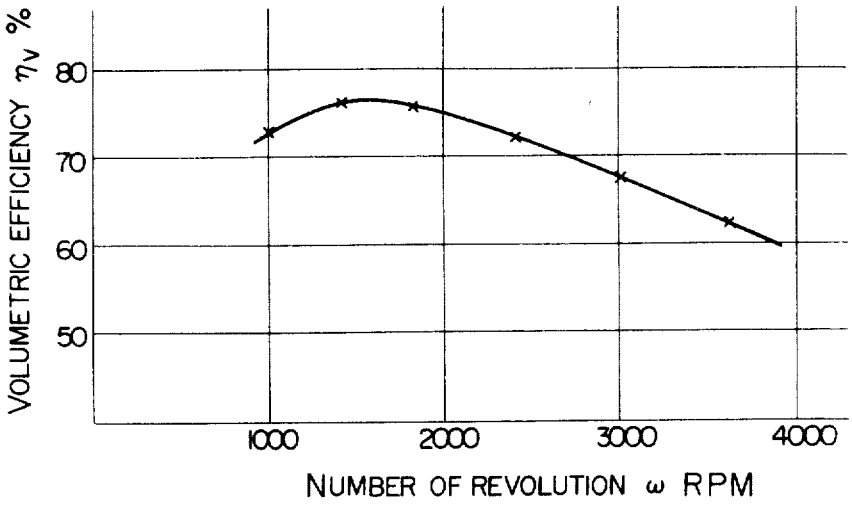
FIG. 9 is a graph showing the actually measured volumetric efficiency $\eta v$ in relation to number of revolution $\omega$ in connection with the compressor shown in FIG. 2.

FIG. 9 shows the volumetric efficiency $\eta v$ as measured with the rotary compressor of the invention. The compressor of this embodiment showed an ideal refrigerating capacity characteristics as shown by the curve n in FIG. 8, against the technical common sense that the undesirable excessive increase of the refrigerating capacity is inevitable in the high speed operation of rotary compressors.

Namely, the rotary compressor of the invention offers the following advantages.

(i) The drop of refrigerating capacity at the low speed operation attributable to the suction loss was negligibly small.

Although a reduction of volumetric efficiency was observed in the region of number of revolution $\omega$ below 1400 rpm in the curve shown in FIG. 9, this was attributed to the refrigerant leakage produced at the sliding portions of the rotary compressor. The reciprocating type compressor having a function of self-suppression of the refrigerating capacity has a feature in suffering only a small suction loss at the low speed operation. The rotary compressor of this embodiment showed a small suction loss which is comparable to that of the reciprocating type comrpressor. Namely, the values of the curves (l) and (m) substantially lap each other in the region of low speed operation.

(ii) A refrigerating capacity suppressing effect which is equivalent to or greater than that of the conventional reciprocating type compressor was obtained at the high speed operation.

(iii) The refrigerating capacity suppressing effect became appreciable when the revolution speed was increased to 1800 to 2000 rpm or higher. This ensures an ideal refrigeration cycle in view of energy saving and favorable feeling of operation, when the compressor is used as the compressor for an automobile air conditioners.

It is quite advantageous that, according to the invention, the ideal and favourable effects (i) through (iii) mentioned above can be achieved without need of adding any additional elements or parts to conventional rotary compressors of sliding vane type.

That is, the present invention makes it possible to embody a rotary compressor having an automatic refrigerating capacity suppressing function, without losing the advantageous features of the rotary compressor, i.e. small size, light-weight and simple construction. In the polytropic change performed during the suction stroke of a compressor, the total weight of the refrigerant in the vane chamber and the compression work become smaller as the suction pressure becomes lower and the specific weight is smaller. Therefore, the compressor of the present invention necessarily produces a reduction in the driving torque at the high speed operation the total weight of the refrigerant is automatically decreased prior to the compression stroke with an increase in the number of revolution.

A refrigerating capacity controlling method has been put into practical use in refrigeration cycle of room air conditioners, in which method a control valve connected between the high-pressure side and the low-pressure side of a compressor is selectively opened to return the high-pressure refrigerant to the low-pressure side thereby to prevent subcooling. This control method, however, suffers a compression loss due to an irreversible re-expansion of the refrigerant at the low-pressure side, resulting in a reduced efficiency of the refrigeration cycle.

With the rotary compressor of the invention, the refrigeration cycle involving saving and high efficiency can be carried into effect the refrigerating capacity can be controlled without any wasteful mechanical work which would product the compression loss. In addition, the rotary compressor of the invention is characterized, as will be fully explained later, by an effective use of the transient characteristics of the vane chamber pressure by suitable combination of various parameters of the compressor. Any mechanically moving parts such as a control valve can be dispensed with. This in turn ensures a high reliability of operation of the compressor.

Furthermore, according to the invention, the unnaturalness of the refrigerating capacity due to discontinuous opening and closing operation of the capacity controlling valve, is eliminated owing to the continuous and smooth change of the refrigerating capacity to embody a favorable control of the refrigerating capacity.

Hereinafter, a detailed explanation will be made as to an analysis of characteristics which was conducted to minutely grasp the transient characteristics of the refrigerant pressure which constitutes an essential of the invention.

The transient characteristics of the pressure in the vane chamber can be described by the following energy equation (2).

$$\frac{C_P}{A} GT_A - Pa\frac{dVa}{dt} + \frac{dQ}{dt} = \frac{d}{dt}\left(\frac{Cv}{A}\gamma a\ Va\ Ta\right) \tag{2}$$

In the above equation (2), G represents the weight flow rate of the refrigerant, Va represents the volume of the vane chamber, A represents the thermal equivalent of the work, Cp represents the specific heat at constant pressure, $T_A$ represents the refrigerant temperature at the supply side, $\kappa$ represents the specific heat ratio, R represents the gas constant, Cv represents the specific heat at constant volume, Pa represents the pressure in vane chamber, Q represents the calorie value, $\gamma a$ represents the specific weight of refrigerant in the vane chamber, and Ta represents the temperature of the refrigerant in the vane chamber. In the following equations (3) to (5), $\alpha$ represents the effective suction passage area, g represents the gravity acceleration, $\gamma_A$ represents the specific weight of refrigerant at the supply side and Pa represents the pressure of the refrigerant at the supply side.

In the equation (2) above, the first term of the left side represents the thermal energy of the refrigerant introduced into the vane chamber through the suction port per unit time, $\gamma$ the second term represents the external work achieved by the refrigerant pressure per unit time and the third term represents the thermal energy delivered from the outside through the wall per unit time. On the other hand, the right side of the equation represents the increase of the internal energy per unit time.

Assuming here that the refrigerant follows the law of perfect gas and that adiabatic change is effected due to rapid suction stroke in the compressor the following equation (3) is derived from the following relations:

$$\gamma a = Pa/RTa,\ dQ/dt = 0$$

$$G = \frac{dVa}{dt}\left(\frac{A}{CpT_A} + \frac{1}{\kappa RT_A}\right) Pa + \frac{Va}{\kappa RT_A}\ \frac{dPa}{dt} \tag{3}$$

In addition, the following equation (4) is obtained by making use of the relationship represented by:

$$1/R = A/Cp + 1/\kappa R \tag{4}$$

$$G = \frac{1}{RT_A}\cdot\frac{dVa}{dt}\cdot Pa + \frac{Va}{\kappa RT_A}\cdot\frac{dPa}{dt}$$

The weight flow rate of refrigerant passing through the suction port can be determined as follows by direct application of theory of nozzle.

$$G = a\sqrt{2g\gamma_A P_s\frac{\kappa}{\kappa-1}\left[\left(\frac{Pa}{Ps}\right)^{\frac{2}{\kappa}} - \left(\frac{Pa}{Ps}\right)^{\frac{\kappa+1}{\kappa}}\right]} \tag{5}$$

Therefore, by solving the equations (4) and (5) in relation to each other, it is possible to determine the transient characteristics of the pressure Pa in the vane chamber.

The volume Va($\theta$) of the vane chamber can be determined to be Va($\theta$)=V($\theta$) when $0<\theta<\pi/2$ and Va($\theta$)=V($\theta$)−V($\theta-\pi$), when $\pi<\theta<\theta_s$, respectively, from the following equation (6) in which m represents the ratio Rr/Rc.

$$V(\theta) = \frac{bRc^2}{2}\left\{(1-m^2)\theta + \frac{(1-m)^2}{2}\sin 2\theta - (1-m)\sin\theta \times \sqrt{1-(1-m)^2\sin^2\theta} - \sin^{-1}[(1-m)\sin\theta]\right\} + \Delta V(\theta) \tag{6}$$

Figure 10:
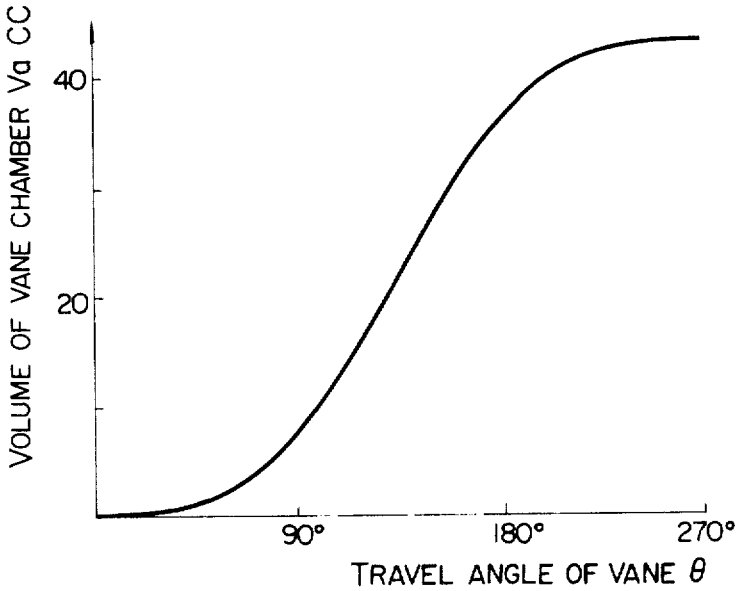
FIG. 10 is a graph showing the relationship between the volume Va of vane chamber in relation to vane travel angle $\theta$ in the compressor shown in FIG. 2.

The term $\Delta V(\theta)$ is a compensation term for compensating for the eccentric arrangement of the vanes in relation to the center of the rotor, and usually falls within an order of 1 to 2%. The volume Va of the vane chamber when the term $\Delta\overline{V}(\theta)$ is zero is shown in FIG. 10.

Figure 11:
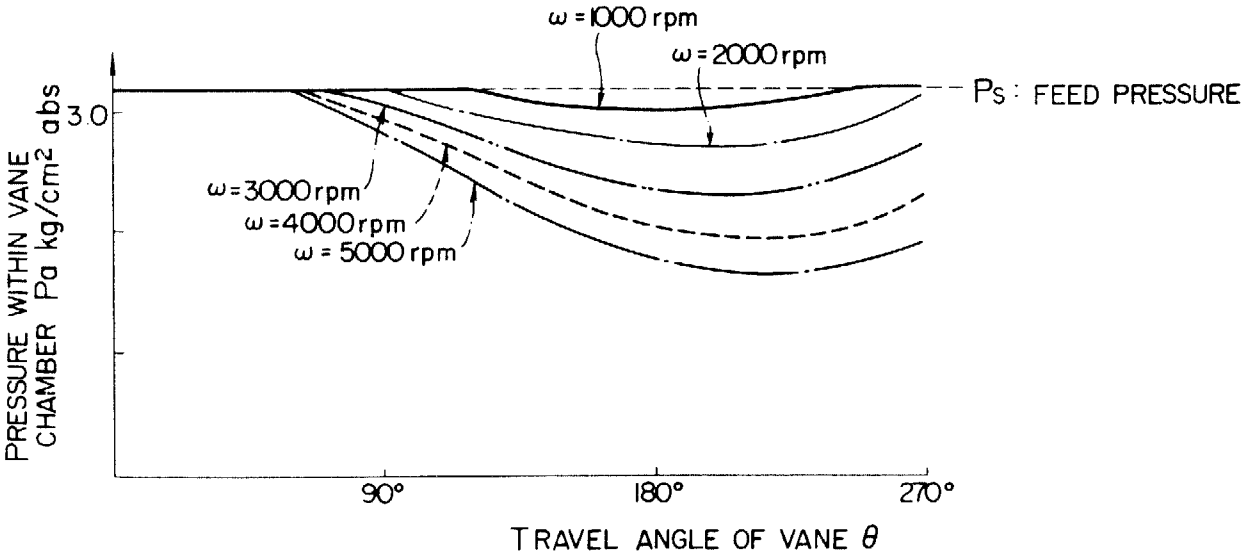
FIG. 11 is a graph showing an example of the transient characteristics of the compressor shown in FIG. 2.

FIG. 11 shows the transient characteristics of the pressure in the vane chamber as obtained by using the equations (4) through (6) and the values in Tables 1 and 2, under the initial condition of t=0 and Pa=Ps, using the number of revolution as a parameter. In the refrigerating cycle of automobile air conditioner, R12 is usually used as the refrigerant. Therefore, the analysis was made on the following assumption.

$\kappa = 1.13$ $R = 668$ Kg·cm/°K. Kg $\gamma_A = 16.8 \times 10^{-6}$ Kg/cm$^3$ $T_A = 283°$ K.

Referring to FIG. 11, in the case of the low speed operation ($\omega = 1000$ rpm), the pressure Pa in the vane chamber has reached the level of the supply pressure Ps=3.18 Kg/cm$^2$ abs at about $\theta = 260°$ prior to the end of the suction stroke, so that no pressure loss in the vane chamber takes place at the end of the suction stroke. As the number of revolution of the compressor is increased, the supply of the refrigerant can no more follow up the increase of the volume of the vane chamber, so that the pressure loss at the end of the suction stroke ($\theta = 270°$) is increased. For instance, at the number of revolution $\omega = 4000$ rpm, a pressure loss of $\Delta P = 1.37$ Kg/cm$^2$ is caused relatively to the supply pressure Ps. In consequence, the total weight of the refrigerant sucked into the compressor is decreased.

Instead of using the equation (6) for determining the volume Va of the vane chamber, it is proposed to seize the relationship between the refrigerating capacity controlling effect and various parameters, by transforming the equations (4) and (5) using the following approximate function.

The maximum suction volume for refrigerant is given as Vo. Also, the angular position $\theta$ is transformed into $\psi = \Omega t = (\pi\omega/\theta_s)t$. The angle $\psi$ can be varied between 0 and $\pi$. The following equation (7) is selected as an approximate function which satisfies the conditions of Va(0)=0 and Va'(0)=0 at the moment t=0 and the conditions of Va($\pi$)=Vo and Va'($\pi$)=0 at the end of the suction stroke, i.e. at a moment $t = \theta_s/\omega$.

$$Va(\psi) \approx (V_o/2)(1 - \cos\psi) \tag{7}$$

The following equation (8) is derived by representing the ratio Pa/Ps by $\eta$.

$$G = \frac{\Omega Vo}{2} \frac{P_s}{RT_A} \left\{ \sin\psi \cdot \eta + \frac{1}{\kappa}(1 - \cos\Psi) \frac{d\eta}{d\psi} \right. \tag{8}$$

Also, the equation (5) can be transformed into the following equation (9).

$$G = a\sqrt{P_s \cdot \gamma_A 2g \frac{\kappa}{\kappa - 1}\left[\eta^{\frac{2}{\kappa}} - \eta^{\frac{\kappa+1}{\kappa}}\right]} \tag{9}$$

The following equation (10) is derived from the above-mentioned equations (8) and (9).

$$K_1 f(\eta) = \sin\psi \cdot \eta + \frac{1}{\kappa}(1 - \cos\psi)\frac{d\eta}{d\psi} \tag{10}$$

In the equation (10), $K_1$ represents a dimensionless value represented by the following equation (11).

$$K_1 = \frac{2a\theta_s}{\overline{V}_o \pi\omega} \cdot \sqrt{2gRT_A} \tag{11}$$

In rotary compressors of the sliding vane type, the theoretical discharge Vth is represented as the product of the number n of the vanes and the volume Vo, i.e. by Vth=n×Vo. The equation (11), therefore, can be rewritten as the following formulae (12).

$$K_1 = \frac{2a\theta_{sn}}{Vth\pi\omega} \sqrt{2gRT_A} \tag{12}$$

In the equation (10) above, the specific heat ratio $\kappa$ is a constant which is determined solely by the kind of the refrigerant. Therefore, in the case where $K_1$ is constant, the solution of the equation (10), i.e. $\eta = \eta(\psi)$ is always uniquely determined.

In other words, in all of the compressors having the same value for the constant $K_1$ pressure loss in the vane chamber at the end of the suction stroke is the same, and the refrigerating capacity control is effected in the same proportion to the theoretical refrigerating capacity Q Kcal which is obtained when there is no pressure loss.

Representing the refrigerant pressure in the vane chamber by Pa=Pas at the end of the suction stroke, the rate of pressure drop $\eta p$ is defined as follows:

$$\eta p = \left(1 - \frac{P_{as}}{P_s}\right) \times 100 \tag{13}$$

Figure 12:
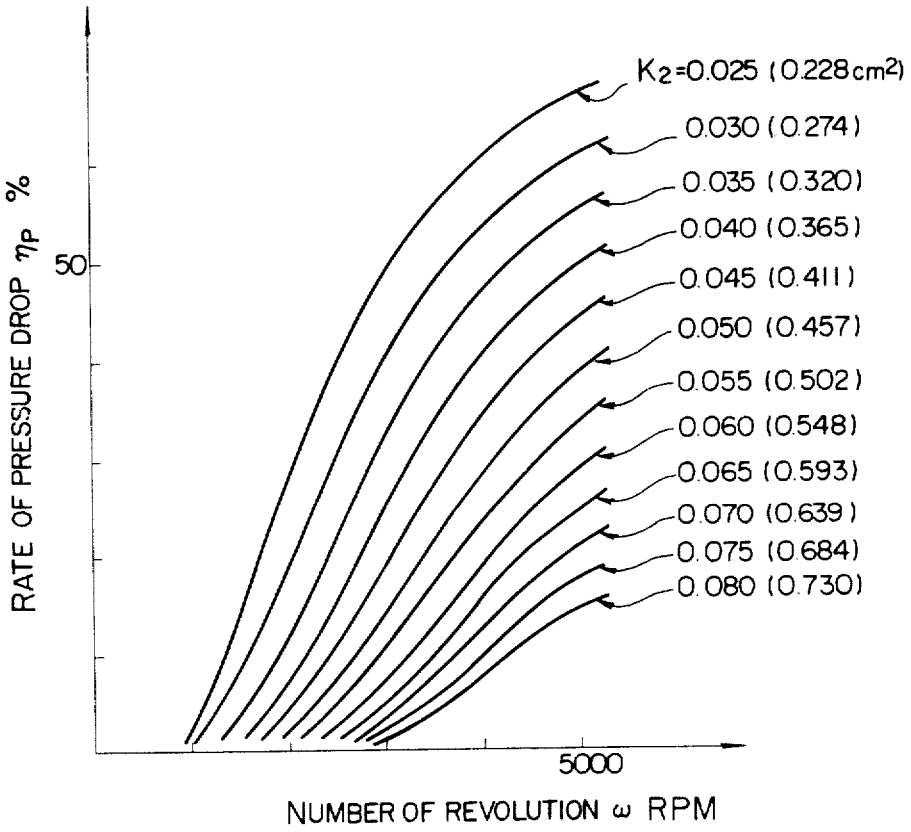
FIG. 12 is a charactersitic diagram showing the pressure drop rate $\eta_p$ in relation to number of revolution $\omega$ of the compressor shaft.

The equations (4) and (5) were solved under the condition of $T_A = 283°$ K. and a superheat of $\Delta T = 10$ deg., using a parameter $K_2$ represented by $K_2 = a\,\theta s/Vo$, to obtain the rate of pressure drop $\eta p$, the result of which is shown in FIG. 12.

From FIG. 12, it will be seen that the pressure loss can be suppressed to the utmost at the low-speed operation of the compressor while effectively permitting the pressure loss to be produced only in the high-speed operation of the compressor, by a suitable selection of parameters for the compressor. The pressure loss characteristics of the compressor in relation to the number of revolution involves a region which may be referred to as a "dead zone" in the range of low speed operation of the compressor. The presence of the "dead zone" constitutes the most important point for maximizing the effect of capacity control in the rotary compressor in accordance with the invention.

In the case of the embodiment specified in Table 1, the constant $K_2$ is calculated as follows.

$$K_2 = \frac{0.450 \times 4.71}{43} = 0.0493$$

From the characteristic diagram shown in FIG. 12, the rate of pressure drop $\eta p$ is determined as 15% when the constant $K_2$ takes the above-specified value and at a speed of $\omega=3000$ rpm, for example. The rate of pressure drop can be regarded as being substantially equivalent to the rate of reduction of the refrigerating capacity. In this respect, the rate of reduction of the refrigerating capacity presents 16% in the test result shown in FIG. 8.

According to the invention, it is possible to obtain various capacity control characteristics as shown in FIG. 12, solely by suitably selecting the spacer 201, without changing the remaining parts of the compressor. In FIG. 12, the numerical values shown in parenthesis show the effective passage area provided by each spacer 201 in the compressor of the described embodiment.

When a refrigeration cycle incorporating the compressor of this embodiment is applied to a particular automobile, the following refrigerating capacity characteristics are required.

(i) The rate of reduction of the refrigerating capacity (rate of pressure drop) should be less than 3% at the speed $\omega=1800$ rpm.

(ii) The rate of reduction of the refrigerating capacity should be greater than 20% at the compressor speed $\omega=3600$ rpm.

In order to meet these requirements, the constant $K_2$ has to fall within the range specified below.

$$0.045<k_2<0.050 \quad (14)$$

Thus, it is possible to obtain a rotary compressor which can meet with the above-mentioned requirements, by suitably selecting the spacer 201 and the parameters of the compressor such as $\theta_s$, n and Vth. If the compressor is constructed to involve the parameters shown in Table 1, the effective suction passage area should be selected to meet the following condition.

$$0.41\ \text{cm}^2<a<0.46\ \text{cm}^2 \quad (15)$$

To this end, a suitable spacer 201 is selected by conducting the experiment explained in connection with FIG. 7, using various spacers 201 having different inside diameters $D_2$.

A test was conducted with actual automobiles which mounted thereon compressors having different values for the parameter $K_2$, the result of which is shown in Table 3.

TABLE 3

| number of revolution | effect of capacity control (pressure drop rate) | value of parameter $K_2$ | test result |
|---|---|---|---|
| 1800 rpm | 22.5% | 0.025 | Efficiency at low speed range lowered slightly, but sufficient refrigerating capacity was obtained when Vth of compressor was greater than 95 cc/rev. |
| | 9.0 | 0.035 | Practically satisfactory although there was a slight drop of efficiency |
| | 4.5 | 0.040 | Extremely small drop of efficiency. Possible to compose ideal, energy saving refrigeration cycle of high efficiency |

TABLE 3-continued

| number of revolution | effect of capacity control (pressure drop rate) | value of parameter $K_2$ | test result |
|---|---|---|---|
| | 21.5 | 0.065 | Best result obtained with capacity control effect and energy saving effect at high speed operation |
| | 18.0 | 0.070 | Effect substantially equivalent to that in conventional reciprocating compressors obtained. Practically sufficient performance. |
| | 12.0 | 0.080 | The effect of capacity control was rather insufficient but refrigeration cycle could be designed for the engine displacement in excess of 2000 cc. |

The experimental data shown in FIG. 8 were obtained on the assumption that the suction pressure Ps and the discharge pressure Pd were constant. In the actual use on automobiles, however, at the high speed operation the suction pressure is decreased while the discharge temperature is increased.

In consequence, without automatic control of the refrigerating capacity, the compression ratio is increased resulting in not only an increase of the compression work (driving torque) but also in an overload of the condenser due to the high discharge temperature of the refrigerant. In the worst case, the air conditioner is injured as a result of the overload. The margin against the overload becomes large as the capacity of the condenser is increased. Therefore, the margin against the excessive refrigerating capacity of the compressor is greater in large-sized automobile than in the small-sized automobile because the large-sized automobile can mount a larger condenser.

From the test result shown in Table 3, it is understood that, taking into account the margin due to variation of the engine displacement, the present invention can practically be applied provided that the parameter $K_2$ falls within the range specified below.

$$0.025<K_2<0.080$$

Hereinafter, a description will be made as to a compressor of another embodiment, having a different construction from that heretofore described.

Figure 13:
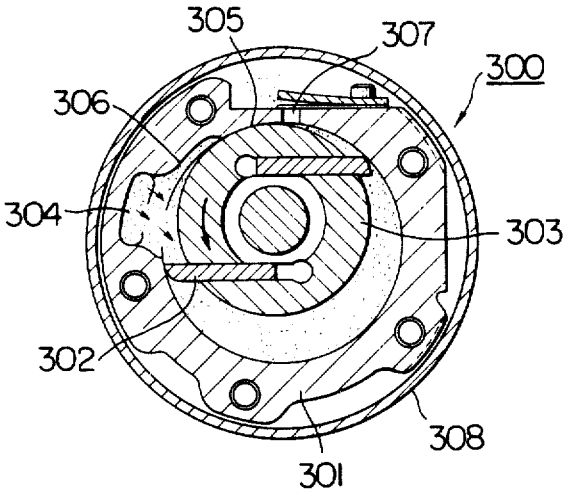
FIG. 13 is a front elevational sectional view of a shell type rotary compressor in accordance with another embodiment of the invention.
Figure 14:
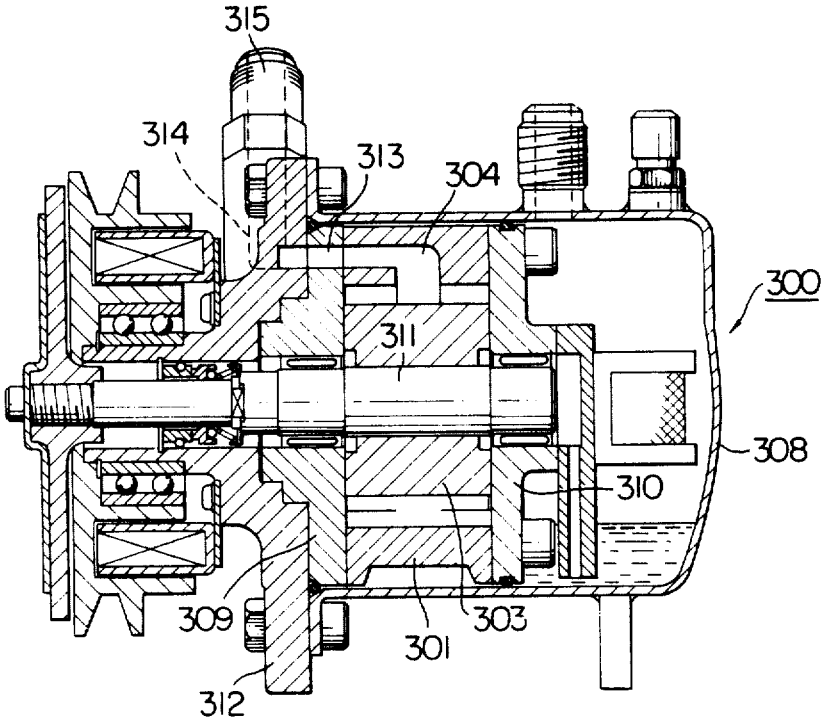
FIG. 14 is a side elevational view of the rotary compressor shown in FIG. 13.
Figure 15:
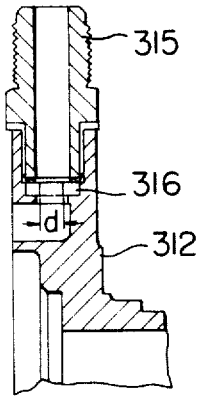
FIG. 15 shows the details of the compressor shown in FIG. 13.

FIGS. 13 to 15 in combination show a second embodiment of the invention applied to a shell type compressor 300 in which the outer wall of the cylinder is contained by a shell vessel.

Referring first to FIG. 13, reference numeral 301 designates a cylinder, 302 a vane, 303 a rotor, 304 a suction port formed in the cylinder 301, 305 a cylinder head, 306 an auxiliary suction groove formed between the cylinder head 305 and the suction port 304, 307 a discharge port and 308 a shell vessel accomodating the cylinder 301.

Referring now to FIG. 14, the compressor 300 further has a front panel 309, rear panel 310, rotor shaft 311, support panel 312, suction passage 313 formed in the front panel, 314 denotes a suction passage in the front panel, suction passage 314 schematically shown by a chain line and formed in the support panel 312, and joint 315 for connecting to the suction pipe.

As will be seen from FIG. 15 showing in section the portion of the compressor 300 around the pipe joint 315, a spacer 316 for adjusting the effective suction area is provided in the compressor 300.

In the compressor of this embodiment, the effective suction area in the suction passage is determined by the inside diameter d of the spacer 316 disposed below the pipe joint 315. Namely, it is possible to obtain any desired refrigerating capacity control characteristics simply by selecting the spacer 316.

Preferred embodiments have been described hereinbefore with respect to the case, in which the suction passage leading to the vane chamber is formed to have a constant effective area throughout the suction stroke. In case the opening of the suction passage to the vane chamber is formed to extend lengthwise in the direction of travel of the vanes so that a variation in the effective area of the opening depending on the position of the vane is not negligible, it is not possible to explain the principle of the invention solely by the parameters $K_1$ and $K_2$. This is because the value 7 can be varied within the range of $0<\psi<\eta$ since the parameter $K_1$ in the equation (10) is a function of $\psi$.

Figure 16:
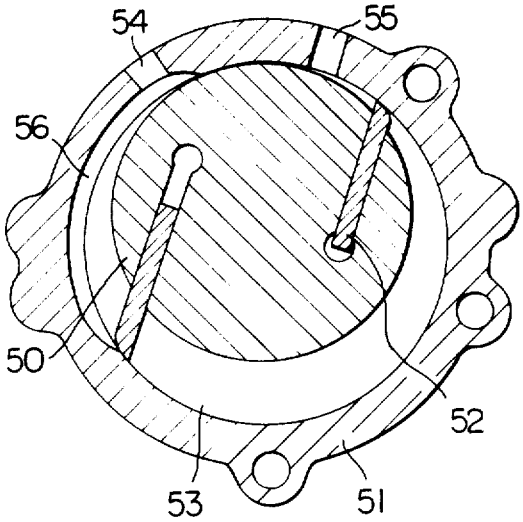
FIG. 16 is a front elevational sectional view of a rotary compressor constructed in accordance with still another embodiment of the invention.

For instance, in the case of a compressor 1 having the suction port 6 provided in the rear plate as shown in FIG. 1, the effective area of the opening suction passage leading to the vane chamber is gradually decreased at the end of the suction stroke when the vane 5 passes over the suction port 6. Also, in case there are provided a suction grooves 56 and a suction port 54 in the inner peripheral surface of the cylinder as shown in FIG. 16 and an effective area $S_1$ determined by the width e, depth f and number of the suction grooves **5*b* and the number is smaller than the area of the suction port 54, the effective area of the suction passage is restricted in the latter half of the suction stroke. As to the symbols e and f, reference should be made to FIG. 5**.

In FIG. 16, reference numeral 50 designates a rotor, 51 a cylinder, 52 vanes, 53 vane chambers, 54 a suction port, 55 a discharge port and 56 a suction groove. If the required characteristics of the compressor permit the form of the suction groove as shown in FIG. 16, it is quite advantageous in terms of mass production because the cross-section of the cylinder can have roundness corresponding to the diameter of a cutter.

Thus, it is possible in common compressors that the effective area of the suction passage varies largely during the suction stroke depending on the working and the entire arrangement.

The application of the invention to such a case will be explained hereinunder.

Figure 17A:
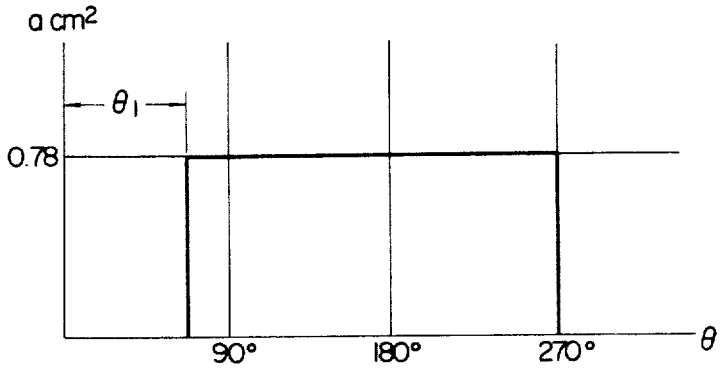
FIG. 17A is a graph showing the effective area of suction passage a($\theta$) in relation to vane travel angle $\theta$ in the case where the suction passage is closed in the first half of the suction stroke.
Figure 17B:
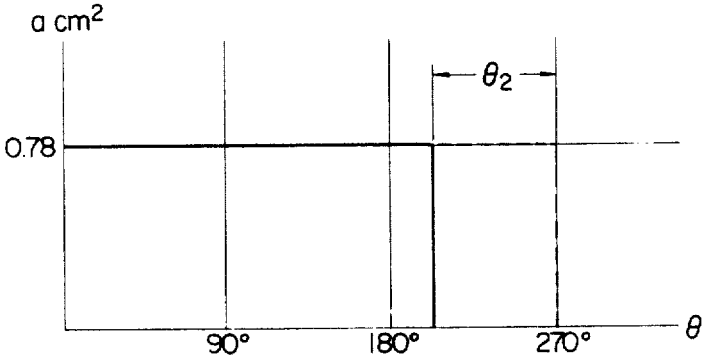
FIG. 17B is a graph showing the effective area of suction passage a($\theta$) in relation to vane travel angle $\theta$ in the case where the suction passage is opened in the latter half of the suction stroke.

(i) When the suction passage is closed in the first half of the suction stroke:

Consideration will be given as to how the ultimately attained as to the pressure of the refrigerant is influenced when the suction passage is closed in the first half part of the suction stroke, i.e. the stop of the in a period in the first half part of the suction stroke, as shown in FIG. 17. Thus, the following numerical experiment was conducted by adopting the values shown in Tables 1 and 2 for the parameters in the equation (11) except for $a(\theta)$ at the number of revolution of 3600 rpm.

Figure 18:
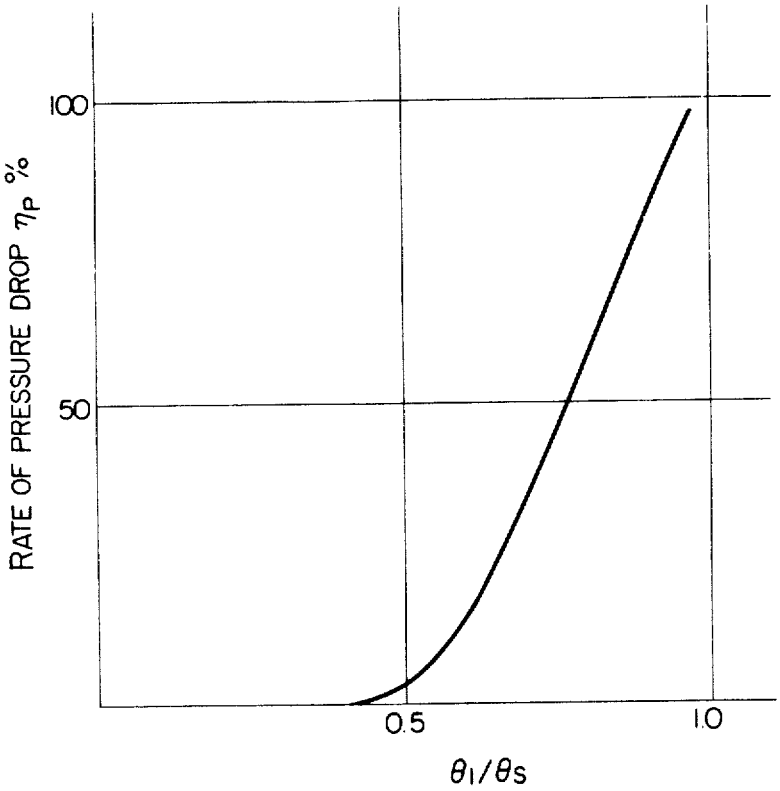
FIG. 18 is a graph showing the rate of pressure drop $\eta p$ in relation to a ratio $\theta_1/\theta_s$.

FIG. 18 shows the rate of pressure drop $\eta p$ in relation to the ratio $\theta_1/\theta_s$, where the region $(a(\theta)=0)$ in which the suction passage in FIG. 17A is covered is represented by $\theta_1$.

When $0<\theta_1/\theta_s<0.5$, the ultimately attained pressure of the refrigerant is never affected whether the suction passage is provided or not. More specifically, the rate of pressure drop $\eta p$ at the end of the suction stroke is determined solely by the suction port area $a(\theta)=0.78$ $cm^2$ in the later half of the suction stroke, regardless of the opened or closed condition of the suction passage or the effective suction area in the first half of the suction stroke.

Figure 19:
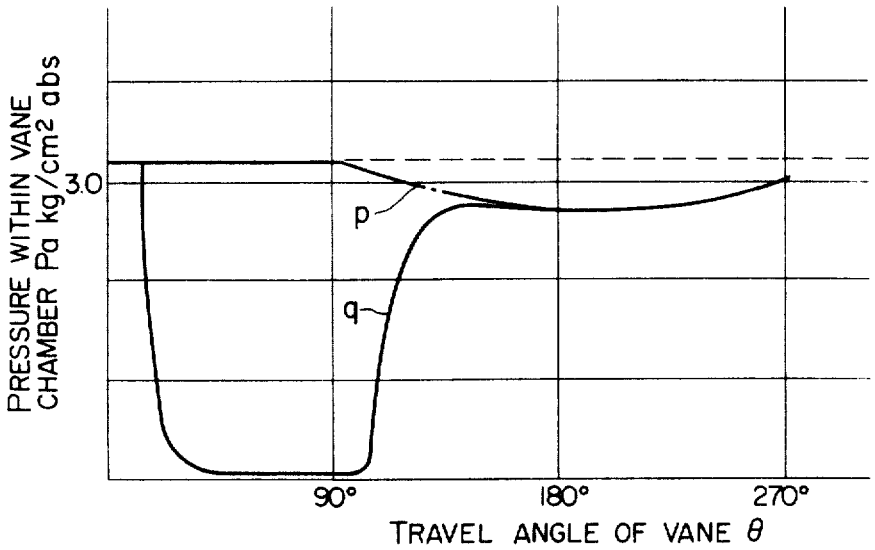
FIG. 19 is a graph showing the transient characteristics of the vane chamber pressure Pa.

FIG. 19 shows the transient characteristics as practical examples of the result of the experiment. In the drawing, the curve p shows the characteristics as obtained when the area of the suction passage is maintained substantially constant throughout the entire stroke, while the curve q shows the characteristics as obtained when the suction passage is closed during a period represented by $0<\theta/\theta_s<0.37$. In the characteristics shown by the curve q, the pressure Pa in the vane chamber is largely decreased during the period in which the suction passage is closed, but the pressure Pa recovers rapidly upon the opening of the suction passage. In fact, there is almost no difference between the characteristics p and q at the end of the suction stroke of $\theta_s=270°$.

Figure 20:
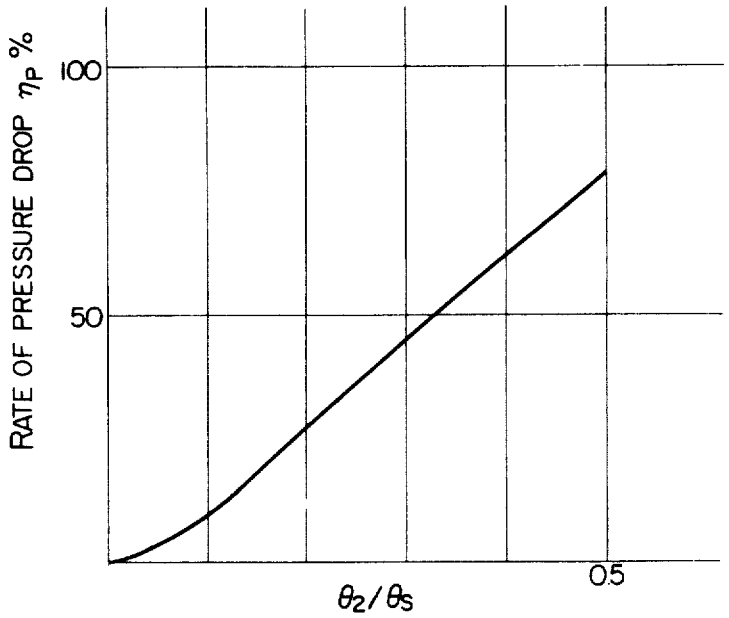
FIG. 20 is a graph showing the pressure drop rate $\eta p$ in relation to the factor $\theta_2/\theta_s$.

(ii) When the suction passage is closed in the latter half of the suction stroke:

FIG. 20 shows how the ultimately attained refrigerant pressure is affected when the suction passage is closed in the latter half of the suction stroke by an angle $\theta_2$.

It will be seen that the rate of pressure drop $\eta p$ is increased in proportion to the angle $\theta_2$ and substantially equals to 80% when the ratio $\theta_2/\theta_s$ amounts to 0.5.

The results of experiments stated in items (i) and (ii) above can be summarized as follows. Namely, the extent, to which the ultimately attained refrigerant pressure is influenced by the opening or closing condition of the suction passage or by the opening area of the same is largely varied by the angular position $\theta$ of the vane in the suction stroke. In the first half of the suction stroke, i.e. in the region expressed by $0<\theta<\theta_s/2$, the extent of such is negligibly small but becomes appreciable gradually toward the position $\theta=\theta_s$.

The result explalined above suggests that, by providing the suction passage area $a(\theta)$ with a weight on a positional basis, is it possible to obtain a suitable mean value $\bar{a}(\theta)$ for any desired function $a(\theta)$.

Figure 21:
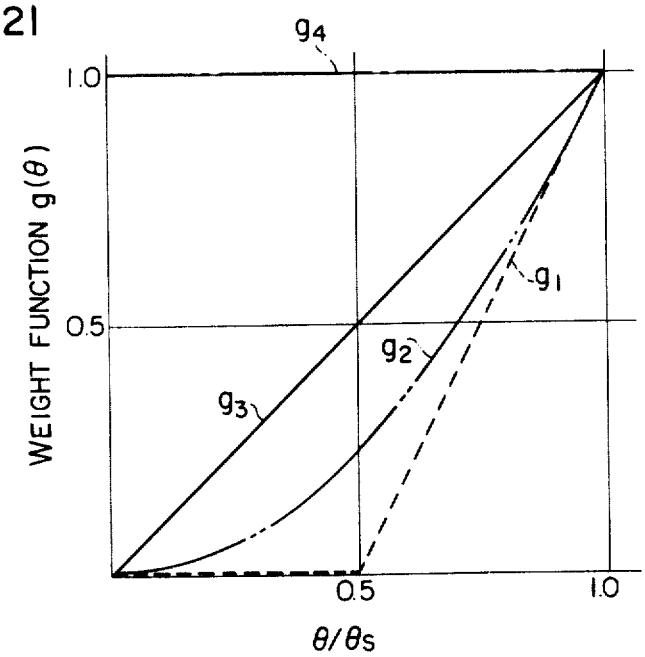
FIG. 21 is a graph showing the characteristics of various weight functions g($\theta$)

FIG. 21 illustrates various weight functions $g(\theta)$. More specifically, the function $g_1$ is $g(\theta)=0$ in the region of $0<\theta/\theta_s 0.5$ and $g(\theta)=2(\theta/\theta_s)^{-1}$ in the region of $0.5<\theta/\theta_s<1$. The function $g_2$ is $g(\theta)=(\theta/\theta_s)^2$ while the function $g_3$ is $g(\theta)=\theta/\theta_s$ and the function $g_4$ is $g(\theta)=1$.

The weight mean $\bar{a}$ is defined here as follows.

$$\bar{a} = \int_0^{\theta_s} g(\theta)\cdot a(\theta)\,d\theta \Big/ \int_0^{\theta_s} g(\theta)\,d\theta \tag{14}$$

Figure 22:
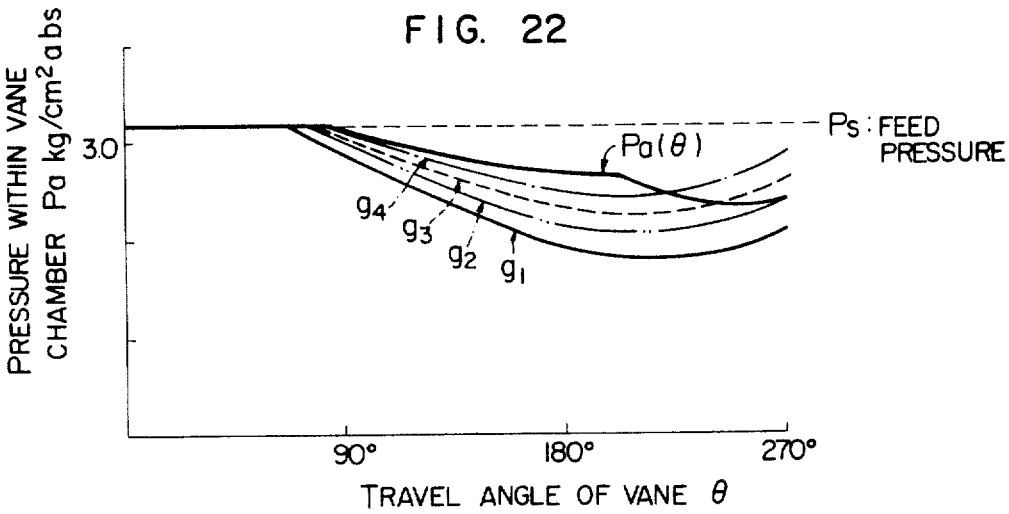
FIG. 22 is a graph showing the examples of the transient characteristics of the vane chamber pressure Pa.

The transient characteristics in FIG. 22 were obtained by using the weight mean $\bar{a}$ obtained from $a(\theta)$ as a function of $\theta$ and the above-mentioned weight functions $g(\theta)$, and using the resulted and the equations (4), (5) under the condition at the parameters shown in Table 1 (for area a) and Table 2 when the number of revolution $\psi$ is 3600 rpm.

Figure 23:
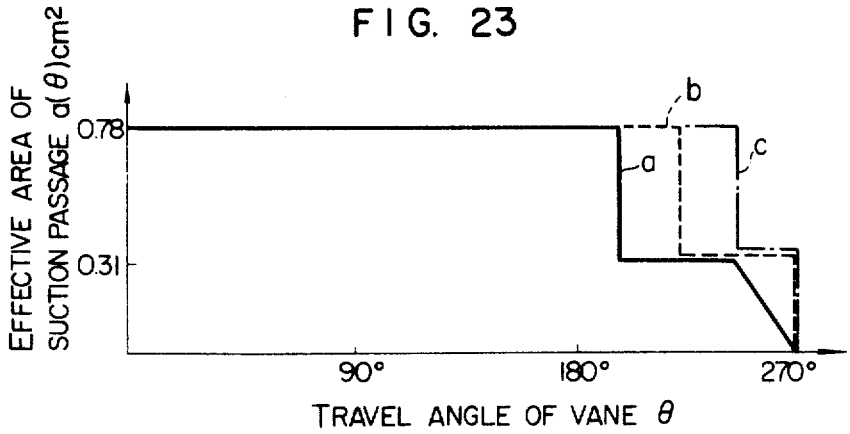
FIG. 23 is a graph showing the effective suction passage area a($\theta$) in relation to the vane travel angle $\theta$.

In the calculation, however, the value represented by a curve (a) in FIG. 23 is used for the area $a(\theta)$ of the suction passage. The curve Pa $(\theta)$ in FIG. 22 is the strict solution obtained without using any mean value, which solution is not a mere analytic solution but is a numerical analytic solution as obtained taking into precise consideration the suction passage area $a(\theta)$.

TABLE 4

| Weight function | Weight mean $\bar{a}$ | Error from strict solution |
|---|---|---|
| $g_1$ | 0.365 $cm^2$ | −9.4% |
| $g_2$ | 0.450 $cm^2$ | 0.3 |
| $g_3$ | 0.530 | 7.9 |
| $g_4$ | 0.630 | 17.3 |

In the result shown in FIG. 22, the strict solution $Pa(\theta)$ exhibits, at the position of $\theta=270°$ where the suction stroke is completed, a pressure loss of $P=0.78$ $Kg/cm^2$ abs relative to the supply pressure Ps of 3.18 $Kg/cm^2$ abs.

The pressure $Pa(\theta)$ obtained through the strict solution exhibits a drastic drop again at the position of $\theta_{s1}=200°$. This is because the effective area of the suction passage is decreased from $a(\theta)=0.78$ $cm^2$ to $a(\theta)=0.31$ $cm^2$.

Table 4 shows errors from the strict solution, which errors were obtained by using various weight functions. Solutions obtained by using the weight means were slightly smaller than the strict solutions when the weight function $g_1$ was used. To the contrary, solutions somewhat greater than the strict solutions were obtained when the weight function $g_2$ was used. Therefore, it proved that there was a relation expressed by $g_1<g_2<g_3$ and that, under the abovedescribed condition, the best approximation was given by the weight function $g(\theta)=g_2=(\theta/\theta_s)^2$.

FIG. 23 shows the effective suction passage $a(\theta)$ in relation to the travel angle $\theta$ of vane in the compressor having a suction groove of the configuration as shown in FIG. 13, for each of the three cases shown in Table 5.

TABLE 5

| | Angle at which effective area is changed | | effective area $\bar{a}$ obtained by using weight function $g_2$ |
|---|---|---|---|
| | $\theta_{s1}$ | $\theta_{s2}$ | |
| a | 200° | 250° | 0.450 $cm^2$ |
| b | 220° | 270° | 0.551 $cm^2$ |
| c | 240° | 270° | 0.631 $cm^2$ |

Figure 24:
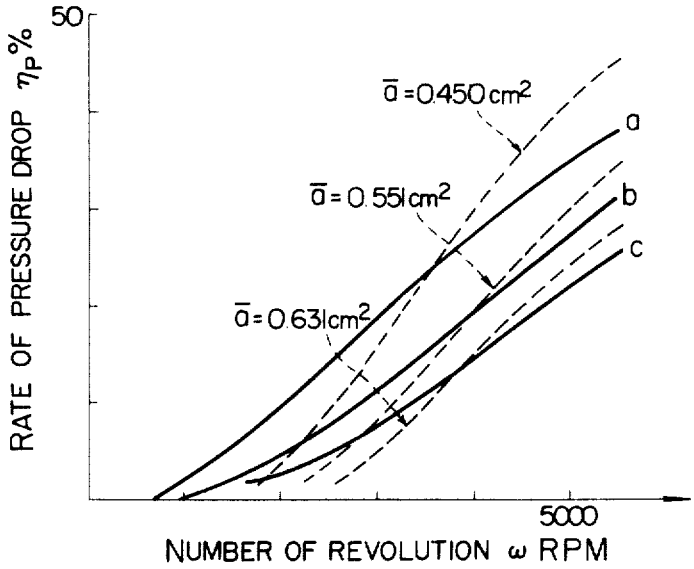
FIG. 24 is a graph showing the pressure drop rate $\eta p$ in relation to the number of revolution $\omega$.

FIG. 24 shows the comparison between the pressure drop ratio in relation to the number of revolution as obtained by using the strict solution and tha obtained by using the weight mean $\bar{a}$, for each of the cases (a), (b) and (c) represented in Table 5. In any of the case, the highly close approximation presents itself in the range of number of revolution $\omega$ between 3000 to 4000 rpm. However, the gradient of the pressure drop rate relative to the number of revolution is more gentle in the case of the stric solution. Therefore, in the region of high operation speed of the compressor, the pressure drop rate obtained by the use of the weight mean $\bar{a}$ is slightly greater than that obtained by the use of the strict solution in the high speed region of operation of the compressor. To the contrary, in the region of low speed operation, the pressure drop rate as obtained through the strict solution is somewhat greater than that obtained by the use of the weight mean.

From this result, it is seen that, in order to obtain an ideal refrigerating capacity control, in the range where the parameter $K_2$ is suitably selected, the case in which the effective suction passage area is constant in the suction stroke is more preferable than the case the effective suction passage area is gradually reduced.

The above-described method using the weight mean provides a practically sufficient precision of approximation. Therefore, is it possible to evaluate the characteristics using the parameter $K_2$ as in the case of the embodiment shown in FIG. 2.

To sum up, the present invention is applied to conventional compressors in which the effective suction passage area is varied in the suction storke, in accordance with the following procedure.

(1) In the region of the vane travel angle $\theta$ expressed by $0<\theta<\theta_s$, the effective area $a(\theta)$ of the passage extending between the evaporator and the vane chamber of the compressor is obtained for various spacers having different inside diameters.

(2) The weight means $\bar{a}$ is determined using the above effective area $a(\theta)$, in accordance with the following equation:

$$\bar{a} = \int_0^{\theta_s} \theta^2 a(\theta)\, d\theta \Big/ \int_0^{\theta_s} \theta^2\, d\theta$$

(3) Subsequently, the parameter $K_2=\bar{a}\ \theta_s\ n/Vth$ is determined by using the value $\bar{a}$ obtained as above.

(4) Then, the refrigerating capacity controlling characteristic is evaluated on the basis of the vaue of the parameter $K_2$ obtained as above, using the data shown in Table 3.

The invention has been described in connection with sliding vane type rotary compressors having two vanes. The invention, however, can be applied to any type of sliding vane type rotary compressors regardless of the number of vanes, discharge rate of the compressor, type of the compressor and other factors. The invention can also be applied even to the sliding vane type rotary compressor having vanes which are not eccentric, although the eccentric arrangement of the vanes from the axis of the rotor involves a large discharge rate. The invention can be applied also to a sliding vane type rotary compressor whether a plurality of vanes are equally angularly spaced or not. In this case, the refrigerating capacity control in accordance with the invention may be effected in the vane chamber having the greater maximum suction volume Vo. It is also possible to apply the invention to a compressor having a cylinder of an oval cross-section, although in the described embodiment the cylinder has a circular cross-section. The invention can be embodied also in a single vane type compressor in which a single vane is slidably received by a diametrical slot formed in the rotor for free sliding motion in the diametrical direction of the rotor.

As has been described, according to the invention, it is possible to provide a compressor which can meet various refrigerating capacity control characteristics suitable for engines and automobiles, simply by mounting a selected spacer in the suction part of the compressor, without changing other parts of the compressor.

This in turn permits the design and construction of various air conditioners matching the characteristics of various automobiles, using a single type of compressor having various inside diameters of spacers. It is thus possible to achieve a remarkable improvement in the reduction of cost in the mass-production, as well as a remarkable increase of the efficiency of the work for designing and producing the air conditioner for automobiles.

What is claimed is:

1. In a sliding vane type compressor, in which a refrigerating capacity during high speed operation is suppressed by a suction loss produced when refrigerant pressure in a vane chamber becomes lower than the pressure of a refrigerant supply source in the suction stroke, and including a rotor haing vanes slidably mounted thereon, a cylinder accommodating said rotor and said vanes, side plates secured to both sides of said cylinder for sidewise closing both open ends of vane chambers defined by said vanes, rotor and said cylinder, and suction and discharge ports respectively communicating with suction and discharge passages and for providing communication between said vane chambers to the outside of said compressor, said suction passage leading from an evaporator to a said vane chamber, the top of said cylinder being positioned at a location where said rotor and cylinder are closest to each other, the improvement in which a spacer provided with an aperture for determining an effective area of said suction passage and for adjusting a self-suppressing action of a compressor refrigerating capacity is mounted near said suction port in said suction passage in such a manner as to meet a condition of $0.025 < \theta_s \bar{a}/Vo < 0.080$, where the parameter $\bar{a}$ is determined by the following equation:

$$\bar{a} = \int_0^{\theta_s} \theta^2 a(\theta)\, d\theta \Big/ \int_0^{\theta_s} \theta^2\, d\theta$$

where $\theta$ represents an angle (rad) formmed between the top of said cylinder and the end of said vane closer to said cylinder around the center of rotation of said rotor, Vo (cc) represents the volume of said vane chamber when said angle $\theta$ is $\theta_s$ radian which is determined by the position of said vane at the end of the suction stroke and $a(\theta)$ ($cm^2$) represents the effective area of the suction passage leading from said evaporator to a said vane chamber as determined by said spacer.

2. A compressor as claimed in claim 1, wherein said spacer has an opening area such that an effective suction passage area is constant throughout the suction stroke of said compressor.

* * * * *